US005914564A

United States Patent [19]

Gabor et al.

[11] Patent Number: 5,914,564

[45] **Date of Patent: *Jun. 22, 1999**

[54] RF DRIVEN SULFUR LAMP HAVING DRIVING ELECTRODES WHICH FACE EACH OTHER

[75] Inventors: George Gabor, Lafayette; Thomas Robert Orr, Castro Valley; Charles Maurice Greene, Oakland; Douglas Gordon Crawford, Orinda; Samuel Maurice Berman, San Francisco, all of Calif.

[73] Assignee: The Regents of the University of California, Oakland, Calif.

[ * ] Notice: This patent is subject to a terminal disclaimer.

[21] Appl. No.: 08/224,036

[22] Filed: Apr. 7, 1994

[51] Int. Cl.[6] ..... H01J 65/04

[52] U.S. Cl. ..... 315/39; 315/248; 315/344

[58] Field of Search ..... 315/39, 248, 267, 315/344

[56] References Cited

U.S. PATENT DOCUMENTS

| | | | |
|---|---|---|---|
| 3,748,520 | 7/1973 | Silver | 313/184 |
| 3,764,843 | 10/1973 | Van Eiji et al. | 313/184 |

(List continued on next page.)

FOREIGN PATENT DOCUMENTS

| | | |
|---|---|---|
| 55 95265 | 7/1980 | Japan . |
| 55 173858 | 12/1980 | Japan . |
| 55 173860 | 12/1980 | Japan . |
| WO91/05450 | 4/1991 | WIPO . |
| WO92/08240 | 5/1992 | WIPO . |
| WO93/21655 | 10/1993 | WIPO . |

OTHER PUBLICATIONS by R.W.B. Pearse, et al., *The Identification of Molecular Spectra,* pp. 292–297, 4th edition (1976).

by D.A. Peterson, et al., *Stable pure sulfur discharges and associated spectra,* J. Chem. Phys., 73(4), pp. 1551–1566, Aug. 15, 1980.

by V.E. Merchant, et al., *Technique for measuring rotational temperature of microwave excited diatomic sulfur,* Applied Optics, vol. 19, No. 18, pp. 3113–3117, Sep. 15, 1980.

by K.J.N. Badura, *Radiative Efficiencies of Radio Frequency Sulfur Discharges,* IEEE Journal of Quantum Electronics, vol. 21, pp. 48–50, Jul. 1985.

by K.E. Greenberg, *Detection of sulfur dimers in $SF_6$ and $SF_6/O_2$ plasma–etching discharges,* Appl. Phys. Lens, 54(14), pp. 1374–1376, Apr. 3, 1989.

by James T. Dolan, *A Novel High Efficacy Microwave Powered Light Source,* Presented as a Landmark Paper on Sep. 2, 1992 at the Sixth International Symposium on the Science and Technology of Light Sources, Technical University of Budapest.

*Primary Examiner*—Benny T. Lee
*Attorney, Agent, or Firm*—Allston L. Jones

[57] ABSTRACT

A high intensity discharge lamp without mercury is disclosed radiating a selected spectrum of which can be almost entirely in the visible range from an envelope that contains a sulfur containing substance. The lamp utilizes a signal source that generates an excitation signal that is externally coupled to the exterior surface of the envelope to excite the enclosed sulfur containing substance. Various embodiments of the lamp use electrodes adjacent the envelope to couple the excitation signal thereto with the face of the electrodes shaped to complement the shape of the exterior surface of the envelope. Two shapes discussed are spherical and cylindrical. To minimize filamentary discharges each envelope may include an elongated stem affixed to the exterior thereof whereby a rotational subsystem spins the envelope. In yet another embodiment the envelope has a Dewar configuration with two electrodes, one positioned near the external curved side surface of the body, and a second to the inner surface of the hole through the envelope. Further, the envelope may contain a backfill of a selected inert gas to assist in the excitation of lamp with that backfill at a pressure of less than 1 atmosphere, wherein the backfill pressure is directly related to the increase or decrease of peak output and inversely related to the increase and decrease of the emitted spectrum from the envelope. The emitting fill can be less than 6 mg/cc, or at least 2 mg/cc of the envelope of a sulfur containing substance.

27 Claims, 9 Drawing Sheet

U.S. PATENT DOCUMENTS

| | | | |
|---|---|---|---|
| 3,873,884 | 3/1975 | Gabriel | 315/267 |
| 3,911,318 | 10/1975 | Spero et al. | 315/39 |
| 3,942,058 | 3/1976 | Haugsjaa | 313/44 |
| 3,984,727 | 10/1976 | Young | 315/267 |
| 4,189,661 | 2/1980 | Haugsjaa | 315/39 |
| 4,266,162 | 5/1981 | McNeill | 315/39 |
| 4,427,920 | 1/1984 | Proud | 315/248 |
| 4,427,922 | 1/1984 | Proud | 315/248 |
| 4,427,925 | 1/1984 | Proud | 315/248 |
| 4,476,413 | 10/1984 | Gough | 313/550 |
| 4,492,898 | 1/1985 | Lapatovich | 315/248 |
| 4,647,821 | 3/1987 | Lapativich | 315/248 |
| 4,683,525 | 7/1987 | Camm | 362/346 |
| 4,792,732 | 12/1988 | O'Loughlin | 315/39 X |
| 4,937,503 | 6/1990 | Sigai | 315/248 |
| 4,945,290 | 7/1990 | Eliasson | 315/246 |
| 5,013,976 | 5/1991 | Butler | 315/39 X |
| 5,039,918 | 8/1991 | Ohtake et al. | 315/39 X |
| 5,241,246 | 8/1993 | Lapatovich et al. | 315/248 |
| 5,289,085 | 2/1994 | Godyak et al. | 315/39 X |
| 5,404,076 | 4/1995 | Dolan et al. | 315/248 X |
| 5,493,184 | 2/1996 | Wood et al. | 315/248 X s |

RF DRIVEN SULFUR LAMP HAVING DRIVING ELECTRODES WHICH FACE EACH OTHER

GOVERNMENT RIGHTS

The United States Government has rights in this invention pursuant to Contract No. DE-AC03-76SF00098 between the U. S. Department of Energy and the Regents of the University of California, for the operation of Lawrence Berkeley Laboratory.

FIELD OF THE INVENTION

The present invention is related to high intensity, highly efficient lighting systems, and more specifically to non-mercury filled lamps.

BACKGROUND OF THE INVENTION

Energy-efficient general lighting with good color rendering is presently provided by gas discharge lamps such as fluorescent, high pressure sodium and metal halide. These lamps achieve energy efficiencies in the range of 60 lumens per watt (lpw) to 110 lpw depending on the power level and other particular features. These lamps are much more efficacious than the common incandescent lamp which at best, with added infrared coatings, can achieve 35 lpw, but are more typically in the range of 15 lpw. Presently, the above listed gas discharge lamps typically use the element mercury, a toxic substance, as a key material for efficient light production.

On May 14, 1992, PCT Publication Number WO 92/08240 entitled "HIGH POWER LAMP" and on Oct. 28, 1993, PCT Publication WO 93/21655 entitled "LAMP HAVING CONTROLLABLE CHARACTERISTICS" (both of which are incorporated herein by reference) were published in which a new mercury-free lamp with excellent color-rendering properties was disclosed. That lamp discussed is capable of producing visible light efficiently at high powers (in the KW range) with the use of environmentally benign sulfur or selenium containing substances including elemental sulfur, elemental selenium or compounds of those elements as the light emitter and is powered by a magnetron operating at microwave frequencies (≈2.25 GHz). The light producing material (sulfur) along with a back fill of inert gas (argon) are contained in a rotatable, small transparent quartz spherical bulb. The reason for the potential of high efficiency and good coloring rendering are that the emitted radiation is essentially continuous broad band spectrum confined mostly to the visible wavelength region.

It would be advantageous to have the greater efficiencies of a sulfur lamp for general lighting applications, including those which operate at low power (under 200 watts). To do so several major and significant technical problems which are exhibited by the prior art need to be solved. The most significant of those problems are:

1. Operation of the sulfur lamp at low power, i.e. 50w/cc and above;
2. Operation of the sulfur lamp at RF frequencies (<1 Ghz) where present day understanding of low power electronic power supplies predict very efficient possibilities (≈90%); and
3. Development of a coupling mechanism whereby the RF power can be efficiently transferred into the sulfur lamp allowing achievement of luminous efficiencies of at least 150 lumens per RF watt.

The present invention provides such a lamp system.

SUMMARY OF THE INVENTION

In accordance with the present invention there is shown a discharge lamp that radiates a spectral energy distribution, almost entirely in the visible range, from an envelope that contains a fill material of a spectral energy emitting component of a sulfur containing substance with the envelope being transparent to the visible portion of the radiated energy. The lamp system also includes a signal source that generates an excitation signal that is externally coupled to the exterior surface of the envelope to excite the spectral energy emitting component to radiate.

In various embodiments of the present invention the excitation signal is coupled to the envelope with at least two electrodes adjacent the envelope separated by an air gap.

In one of those embodiments, the exterior surface of the envelope has a preselected shape and each of the electrodes has a face that is shaped to complement the shape of the exterior surface of the envelope. In this embodiment, the electrodes are positioned with their face spaced-apart a preselected distance from the exterior surface of the envelope to maximize the efficiency by coupling of the excitation energy to the interior of the envelope.

One of those envelope shapes is spherical and the face of the electrodes is a convex partial sphere congruent with the spherical shape of the exterior surface of the envelope.

Another of those envelope shapes is cylindrical and the face of the electrodes is a convex partial cylinder to complement the cylindrical shape of the exterior shape of the envelope.

To minimize filamentary discharges (undesirable and destabilizing needle-like streamers) that can occur within the envelope during operation of the embodiments with shaped the electrodes described above, each envelope includes an elongated stem affixed to the exterior thereof and the discharge lamp also includes a rotational subsystem coupled to the elongated stem of the envelope to rotate the envelope about the stem.

In the case of the spherically shaped envelope, the elongated stem is affixed thereto so that the elongated axis of the stem is aligned with a major spherical axis of the envelope. For the cylindrically shaped envelope, the elongated stem is affixed thereto so that the elongated axis of the stem is aligned with the central cylindrical axis of the envelope.

In yet another embodiment of the present invention, the envelope has a Dewar configuration. In the Dewar configuration the envelope includes a body portion and an elongated hollow stem. The body portion has a cylindrically shaped exterior with a top surface, a bottom surface and a curved side surface substantially perpendicular to and extending between the circumferences of each of the top and bottom surfaces with a hole, having an inner surface, defined between the top and bottom surfaces at the central cylindrical axis of the body portion. The elongated hollow stem has an axis that is the length of the stem with the stem affixed to the top surface of the body portion with the axis of the stem aligned with the central cylindrical axis of the body portion and the hole defined through the body portion. The resultant shape of the interior cavity of the Dewar configuration thus is a cylindrical toroid. For use with the total system of the discharge lamp as described broadly above, the excitation coupling device includes two electrodes. A first electrode that is affixed to at least a portion of the curved side surface of the body portion of the envelope, and a second electrode affixed to at least a portion of the inner surface of the body portion of the envelope. Further, the first and second electrodes are coupled to the excitation signal source to complete the discharge lamp with this type of envelope.

Further, the interior space of the envelope of any shape may contain a backfill of a selected inert gas or gasses to assist in the excitation of the spectral energy emitting component when excitation energy is applied to the envelope. In the present invention this backfill gas is at a pressure of less than 1 atmosphere. The inert gases used are Argon, Krypton and Xenon since by varying the backfill pressure of any these gases the peak wavelength and intensity of the emitted light from the envelope can be selected, wherein an increase in the backfill pressure of the selected inert gas causes the spectral energy distribution emitted from the envelope to peak at a lower visible wavelength and a decrease in the backfill pressure of the selected inert gas causes the spectral energy distribution emitted from the envelope to peak at a higher visible wavelength.

For the lower power discharge lamp of the present invention the spectral energy emitting component fill of the envelope can be less than 6 mg of a sulfur containing substance per cc of the volume of the interior space of the envelope. Similarly, the spectral energy emitting component fill of the envelope can be at least 2 mg of a sulfur containing substance per cc of the volume of the interior space of the envelope.

According to another embodiment of the present invention as broadly described above can have an RF signal as the excitation signal to excite the spectral energy emitting component fill of the envelope. That RF signal can have a frequency of less than 1 GHz. Similarly, the RF signal can have a frequency of at least 10 MHz.

For those envelope configurations that include electrodes external to and adjacent to exterior surface of the envelope, the preselected shape of the face of the electrodes minimizes the distance between the face of the electrodes and the exterior surface of the envelope resulting the minimization of the reactive coupling component of the RF energy due to the air gap between the exterior surface of the envelope and the face of the electrodes.

In an embodiment of the RF excited discharge lamp described broadly above, less than 100 watts of RF power is coupled to the interior space of the envelope per cc of the volume of the interior space. Similarly, in another embodiment of the RF excited discharge lamp described broadly above, more than 20 watts of RF power is coupled to the interior space of the envelope per cc of the volume of the space.

The invention will be better understood by referring to the accompanying drawings wherein:

DESCRIPTION OF THE PREFERRED EMBODIMENTS

A. Lamps of the Present Invention in General

Figure 1:
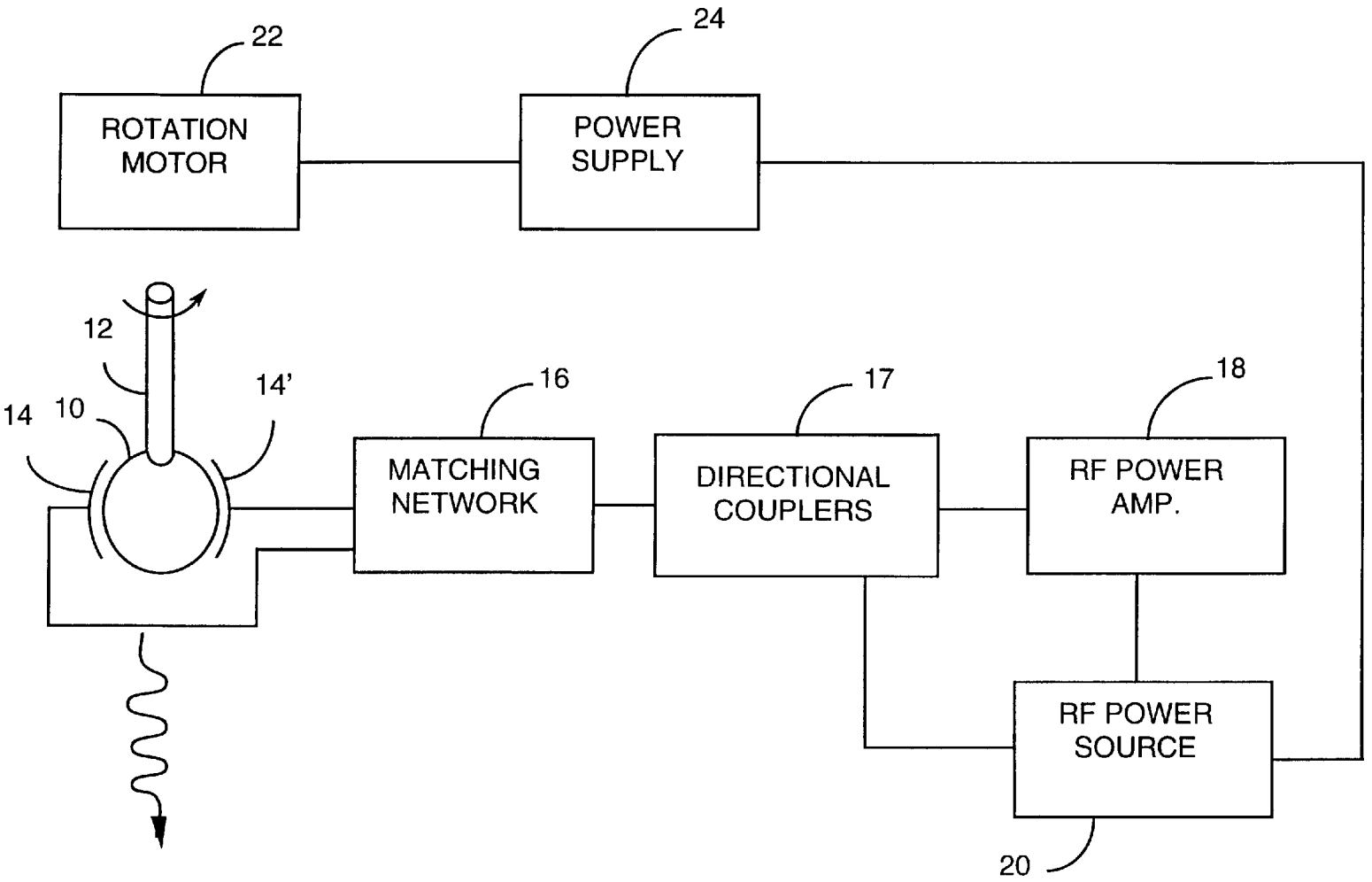
FIG. 1 is a block diagram of the lamp of the present invention.

FIG. 1 is a block diagram which illustrates the component parts of a sulfur lamp of the present invention. Shown are the sulfur containing bulb 10 with stem 12 bonded thereto, and with electrodes 14 and 14' spaced apart from the surface of bulb 10 by a pre-selected distance. In two of the embodiments of the present invention, bulb 10 is spun between electrodes 14 and 14' at a pre-selected speed by rotation motor 22 via stem 12. In another embodiment, the RF signal is applied to the bulb in a different manner, as discussed below. Also shown in FIG. 1, RF power/source 20 applies a signal of a selected frequency to RF power amplifier 18 and then to directional coupler 17. Directional coupler 17, in turn provides feedback to RF power/source 20 and the RF power signal to matching network 16 for application of the RF signal (10 MHz to 1 GHz was used during developmental tests) to electrodes 14 and 14'. Finally, there is shown a block identified as power supply 24 which represents the local AC or DC electric power system for operating rotation motor 22 and RF source 20.

Figure 2:
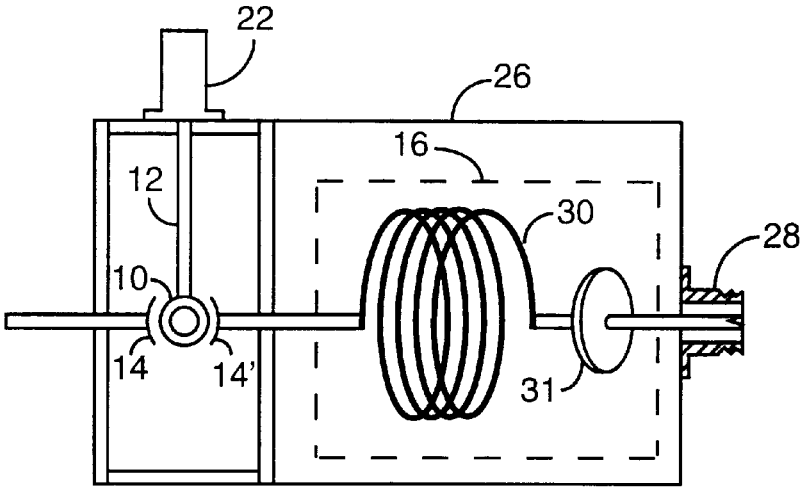
FIG. 2 is a simplified partially cut-away view of a lamp of the present invention.

Referring next to FIG. 2 there is shown a simplified mechanical representation of the sulfur lamp of the present invention. Here again is shown sulfur containing bulb 10 and the attached stem 12 which is rotatable by rotation motor 22 between two electrodes 14 and 14'. The RF network section of the lamp of the present invention is represented here by module 26 which includes matching network 16 therewithin. Here, matching network 16 is shown containing an RF coil 30 in series with a Rogowski coil 31, with module 26 receiving power from lamp base 28 when that base is connected to the local electrical utility via a mating socket (not shown). (Note that module 26 in FIG. 2 contains the elements of block 16, 17, 18, 20 and 24 of FIG. 1.) Additionally, though not shown here, motor 22 receives power from the electrical utility via lamp base 28. In commercial applications the lamp can be modularized to permit portions that fail at different times to be replaced individually which may be a cost saving factor. The modules, for example, may be, referring to FIG. 2, the housing containing bulb 10 with attached stem 12 and electrodes 14 and 14', spin motor 22, and RF excitation module 26. In FIG. 2 electrode 14' is shown passing through the wall that divides module 26 from the region that contains lamp 10 with the stem of electrode insulated from the side-wall of module 26 with an insulator (e.g. Teflon). Electrode 14 is connected to the conductive case (i.e. ground) of module 26 to complete the circuit.

Bulbs 10, during the development of the present invention, were made by blowing a quartz envelope on a precision glass working lathe with a hydrogen/oxygen flame. During that developmental process it was learned that vacuum annealing of the bulb envelope prior to filling with sulfur, inert gas and any other material, would reduce the diffusion of substances into and out of the bulb wall during lamp operation. Once bulb 10 is formed, quartz stem 12 is aligned with the center of bulb 10 and then bonded to bulb 10.

The vacuum system configuration is an important element in the manufacturing of contaminant free sulfur lamps. In the development of the present invention, the basic pumping system included a turbo pump connected to a 4-inch manifold that lead to the lamp filling ports and gas fill delivery system. An RGA (Residual Gas Analyzer) was used in parallel with the turbo pump and the 4-inch manifold with the lamp filling ports located as close as physically possible to the 4-inch line to facilitate rapid pumping and accurate detection of possible contaminants. The gas fill delivery system was located directly adjacent to the filling ports so as to minimize the path from the source to the bulb, thus reducing the possibility of contamination from the system itself. The fill gasses were passed through a coil in the delivery line which was immersed in a dry ice/acetone bath during filling to freeze out any excess water vapor. Before each suite of lamps was filled, a background spectrum was taken of the vacuum system with the RGA to ensure that no contamination existed prior to filling.

Also, during development, to ensure reproducibility and accurate comparisons of one lamp to the next, the sphericity and volume of each bulb 10 were accurately measured prior to filling. Graphite molds were employed in the bulb forming process and after forming, the volume of each bulb 10 was measured by filling the bulb with liquid using a precision syringe. The wall thickness was also measured with an ultrasonic thickness gauge in several locations and the outer diameter was measured with vernier calipers. For the 1 cc/1 mm thick wall lamp the outer diameter was kept to 14.6 mm±0.02 mm during development, however, in production none of the measurements need be controlled that critically. The sulfur placed in each lamp was measured with an analytic balance and was noted to the 0.1 mg level with a tolerance of±0.05 mg.

Prior to filling bulb 10 with inert gas, the gas was passed through a cooling coil as described above and a background spectrum of the gas as it exists in the pumping system was taken to assure cleanliness of the backfill. This also, while it has an effect on operation, is not necessary to control the cleanliness as accurately during production of a commercial lamp, as is also discussed below.

During development of the present invention, the sulfur lamps were rotated during operation at speeds ranging from approximately 200 rpm to 6000 rpm with a small DC motor 22 mounted in a single block of aluminum. The motor had sufficient mass to ensure the stability which is necessary because of the mechanical tolerances between bulb 10 and electrodes 14 and 14' during operation. Motor 22, shown in FIGS. 1 and 2, was connected to lamp stem 12 with a double ended collet mounted inside two sets of precision ball bearing races. The collet was connected to the motor shaft with a vibration damping coupling with the entire lamp rotation fixture, in turn, mounted on the RF driving structure 26 with sliding tension springs allowing for accurate bulb 10 positioning between the electrodes (14 and 14'). In production, other motor designs which attain the same results can be used.

The RF power delivery system during development consisted of an RF signal source 20 (HP 8505A network analyzer), a power amplifier 18 (ENI A-300), and a coil 30 within a cavity 16 connected to electrodes 14 and 14'. The cavity was approximately 7×7×9-inches with coil 30 formed around a cylinder and positioned inside cavity 16 with a Teflon cross structure. Coil 30 was made of small diameter copper tubing connecting the input from power amplifier 18 via a N type connector to the corresponding driving electrode 14 and 14'. Both of the driving electrodes, in this configuration used during development, passed through a Teflon sheet placed at the front end of the RF driving structure and were positioned in line with a ground electrode, the ground electrode being connected to the exterior of the RF driving structure via an aluminum cross and four aluminum posts. The relative spacing and positioning of the electrodes was achieved by threading the driving and the ground electrodes, and respectively affixing them to the Teflon and aluminum crosses. This also is only one example of the configuration of the RF power delivery system of the present invention. Many other configurations could be used for a general production commercial lamp.

Electrodes 14 and 14' may be made of various conductive materials, including brass or platinum plated brass, with the face of each electrode 14 and 14' machined to simulate the three dimensional spherical curvature of bulb 10 to apply the RF power to bulb 10 uniformly. As will be discussed below, the shape of the face of electrodes 14 and 14' is determined by several different factors, e.g. the shape of bulb 10, the amount of light from bulb 10 to escape from between the electrodes, and the prevention of an overly hot spot between bulb 10 and each electrode 14 and 14' to prevent bulb 10 from melting or deforming.

In development it was further determined that bulb 10, in the shape of a small sized sphere (10 mm to 15 mm diameter) provides a highly desirable point source for efficient optical coupling and distribution, while the absence of any known chemical reactions between the bulb contents and the quartz envelope suggest an exceptionally high degree of lumen maintenance and a potential longevity of more than 100,000 hours. Such long lifetimes would make it possible for the low power sulfur lamp to be an integral component of a building's permanent energy system, street light systems and any other situations where high intensity lighting may have application. These features, coupled with the high degree of energy efficiency, suggest that a lamp in accordance with the present invention should be of substantial interest to the energy producing and lighting communities (e.g. cities that wish to reduce their street lighting costs through more efficient, low power, long life street lighting systems).

Figure 3A:
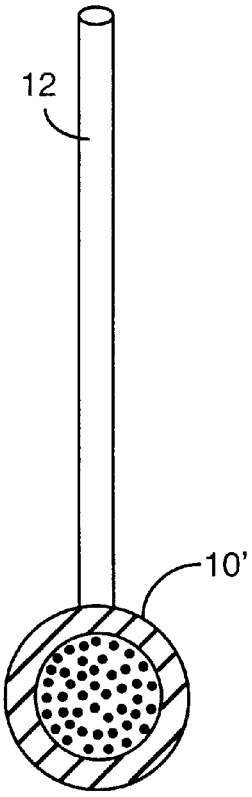
FIG. 3*a* is a partial cut-away view of a spherical lamp of the present invention.
Figure 3B:
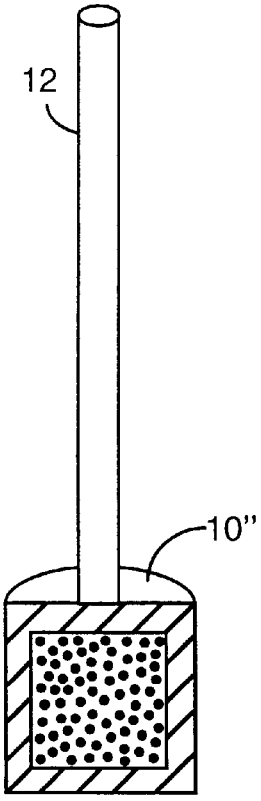
FIG. 3*b* is a partial cut-away view of a cylindrical lamp of the present invention.
Figure 3C:
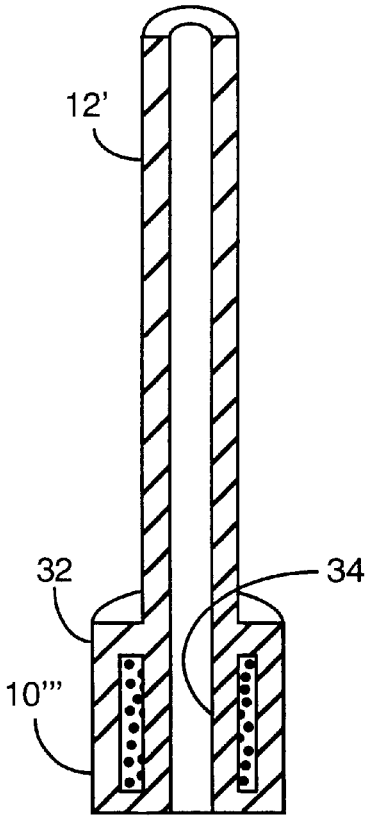
FIG. 3*c* is a partial cut-away view of a Dewar configuration lamp of the present invention.

B. Bulb Geometry:

Next, shown in FIGS. 3*a*–3*c*, are three possible configurations of bulb 10 and stem 12 assemblies. In FIG. 3*a*, bulb 10' is spherically shaped both inside and outside with stem 12 mounted such that the center line of stem 12, when extended into bulb 10', passes through the center of bulb 10'. Similarly, in FIG. 3*b*, bulb 10" is cylindrically shaped both inside and out with stem 12 mounted such that the center line of stem 12, when extended into bulb 10", is the center line of the cylindrical shape of bulb 10". Each of the lamp configurations shown in FIGS. 3*a* and 3*b* are designed to be rotated.

In FIG. 3*c*, a Dewar configuration, which does not require rotation, is shown with bulb 10''' being a cylindrical ring both inside and out with a central hole therethrough— a cylindrical toroid. Also stem 12' is a hollow tube that is in alignment with the central hole through bulb 10'''. In this configuration, one electrode is plated on the outer cylindrical surface 32 of bulb 10''' and a second electrode 34 is plated within the central hole that passes through bulb 10'''. In this configuration electrodes 32 and 34 function as electrodes 14 and 14' in FIGS. 1 and 2, and are connected to RF section 26 as shown in FIG. 2 in place of the connection to electrodes 14 and 14'. During development, several Dewar lamps were built to explore the effects of making the divergence of the electric field non-zero so that rotation of the lamp was not necessary. During the development phase Dewar shaped bulbs 10''' with an inner diameter of 5 mm and an outer diameter of 10 mm were tested.

It is noted that the spherical bulb 10' when rotated provides a volume mixing effect via the Coriolis force that helps to both reduce the "streamer" formation (i.e. filamentary discharges) and a raising of the gas temperature within bulb 10'. In this configuration, the gas temperature is primarily a function of the field gradient provided by electrodes 14 and 14', therefore electrode spacing from the surface of bulb 10' or 10' directly effects the internal gas temperature. A bulb 10' having a 14.6 mm diameter with a 1 mm wall thickness has an internal volume of 1 cc. Other bulbs 10' with volumes of 0.6 cc and 2.0 cc, with differing wall thickness, were also tested.

Figure 4A:
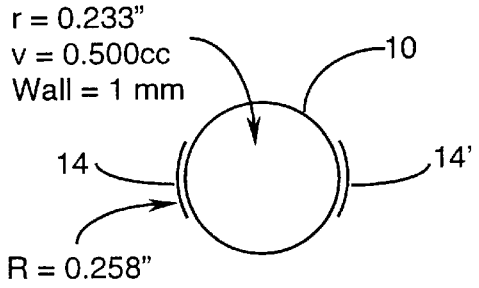
FIG. 4*a* is a simplified diagram of a configuration of a spherical bulb having a radius of 0.233 inches, an internal volume of 0.500 cc and a wall thickness of 1 mm, and associated RF electrodes having a radius of curvature of 0.258 inches tested during development of the present invention.
Figure 4B:
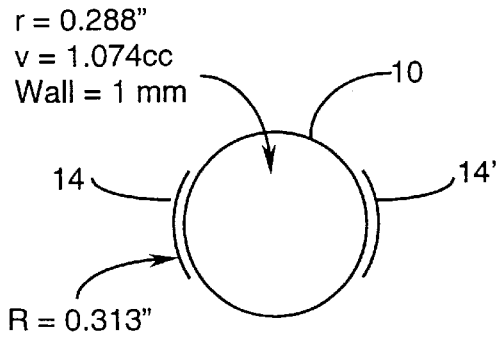
FIG. 4*b* is a simplified diagram of a configuration of a spherical bulb having a radius of 0.288 inches, an internal volume of 1.074 cc and a wall thickness of 1 mm, and associated RF electrodes having a radius of curvature of 0.313 inches tested during development of the present invention.
Figure 4C:
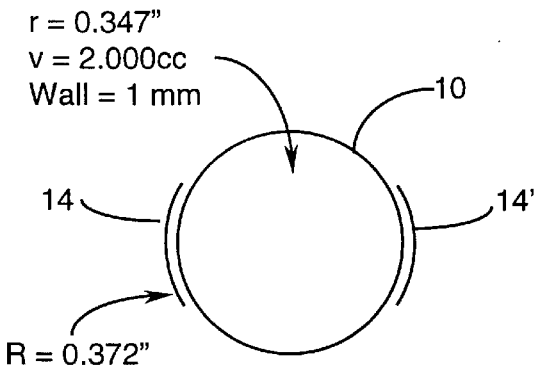
FIG. 4*c* is a simplified diagram of a configuration of a spherical bulb having a radius of 0.347 inches, an internal volume of 2.000 cc and a wall thickness of 1 mm, and associated RF electrodes having a radius of curvature of 0.372 inches tested during development of the present invention.

FIGS. 4*a*–4*c* illustrate three different sizes of spherical bulbs 10' (respectively, r=0.233 inches and v=0.500 cc; r=0.288 inches and v=1.074 cc; and r=0.347 inches and v=2.000 cc) that were tested during the developmental stage of the present invention wherein each of the bulbs illustrated have a 1 mm wall thickness. Also shown in those figures is what was believed to be the optimum size of electrodes 14 and 14' in relation to the diameter and wall thickness of the corresponding bulb 10' (the respective radius of curvature of each being, R=0.258 inches; R=0.313 inches; and R=0.372 inches).

Figure 4D:
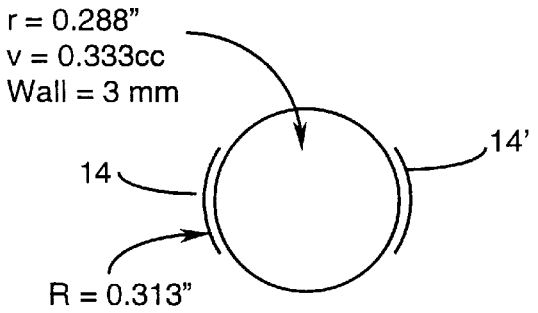
FIG. 4*d* is a simplified diagram of a configuration of a spherical bulb having a radius of 0.288 inches, an internal volume of 0.333 cc and a wall thickness of 3 mm, and associated RF electrodes having a radius of curvature of 0.313 inches tested during development of the present invention.
Figure 4E:
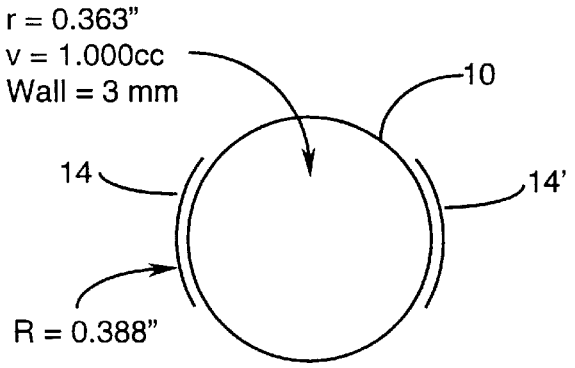
FIG. 4*e* is a simplified diagram of a configuration of a spherical bulb having a radius of 0.363 inches, an internal volume of 1.000 cc and a wall thickness of 3 mm, and associated RF electrodes having a radius of curvature of 0.388 inches tested during development of the present invention.
Figure 4F:
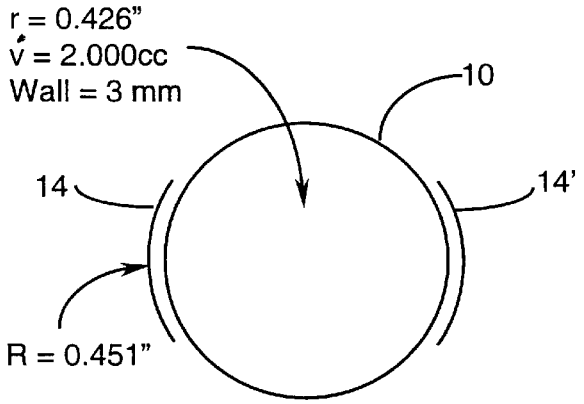
FIG. 4*f* is a simplified diagram of a configuration of a spherical bulb having a radius of 0.426 inches, an internal volume of 2.000 cc and a wall thickness of 3 mm, and associated RF electrodes having a radius of curvature of 0.345 inches tested during development of the present invention.

Similarly, FIGS. 4*d*–4*f* illustrate three different sizes of spherical bulbs 10' (respectively, r=0.288 inches and v=0.333 cc; r=0.363 inches and v=1.000 cc; and r=0.426 inches and v=2.000 cc) that were tested during the developmental stage of the present invention with each of the bulbs illustrated having a 3 mm wall thickness. Also shown in those figures is what was believed to be the optimum size of electrodes 14 and 14' in relation to the diameter and wall thickness of the corresponding bulb 10' (the respective radius of curvature of each being, R=0.313 inches; R=0.388 inches; and R=0.451 inches).

Cylindrical bulbs 10" of 1 cc and 2 cc were built to determine the effects of the mixing of a the sulfur and gas within bulb 10". Since strong Coriolis force is absent in a cylindrical shape, the buoyancy effect was permitted to dominate the mixing. Experimental results indicate it is sufficient if the field gradient between electrodes 14 and 14' is low. Here it was also determined that cylindrical electrodes provide a more uniform field gradient, and a potentially lower reactive component.

C. Electrode Requirements:

It has been determined that shape and placement of electrodes 14 and 14' are very important to, and highly influential in determining, the efficiency of the light emitted by the lamp of the present invention. A symmetrical conformal design was used for the shape of the electrodes, which was determined by the shape of bulb 10. It was also observed that the thermal growth of electrodes 14 and 14' and the centering of bulb 10 between electrodes 14 and 14', as well as the spacing between bulb 10 and electrodes 14 and 14', also contributed to the possibilities of thermal hot spots on bulb 10.

D. Bulb Physics:

Sulfur Chemistry— Sulfur is a very reactive substance, being a group VI element, thus it readily forms oxides, sulfides, and halides. That reactivity of sulfur precludes the use of unprotected metallic electrodes inside the bulb to produce a discharge. Therefore a low power, external means was devised to excite the sulfur in the bulb. Quartz was selected since it is composed only of silicon and oxygen, is transparent in the visible light region, acts as a blackbody at wavelengths greater than 5.5 microns, and has a high temperature softening point and Young's modulus.

Sulfur vapor is composed of many polyatomic forms that range from $S_{16}$ to $S_2$, of which the larger molecules are rings. The vaporization of the solid form of the included sulfur starts at about 113° C., the melting point of sulfur.

It is known in the art that sulfur compounds perform similarly to elemental sulfur in applications such as those of the present invention.

Figure 5:
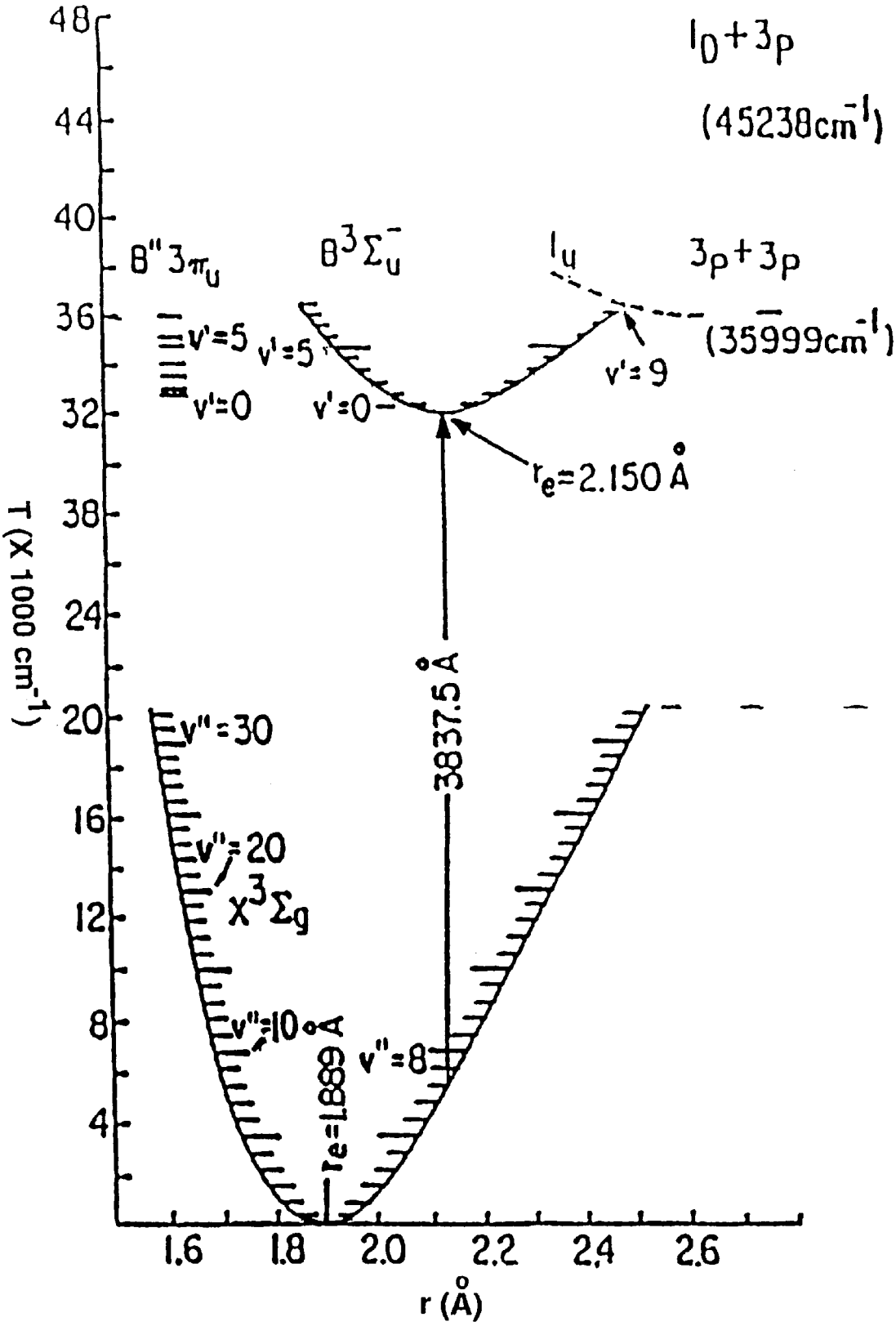
FIG. 5 illustrates $S_2$ potential energy curves for Sigma g and Sigma u states and illustrates the spectra and discharges of sulfur in those states.

Electronic States— The sulfur dimer has been used to make a laser emitting in the UV range, but in the present system, the state mixing, because of the pressure broadening and the short path length of the gas, makes the gain less than 1. The sulfur dimer is a degenerate rotational system with only linear vibrational states available to the two shared P electrons. FIG. 5 is an energy diagram for sulfur in which three energy states are illustrated: the ground state in the lower portion of FIG. 5; and two excited states in the upper portion of FIG. 5 with the transition between the lowest excited state and the ground state being 3837.5 Å. It is well-known that Sigma g states of sulfur (see FIG. 5) have a 0.080 eV spacing, becoming an harmonic at <<1 eV and ends at 3.1 eV. The upper Sigma u states of sulfur (see FIG. 5) have 0.170 eV spacing, with 9 levels before dissociation at 4.4 eV. A unique feature of the present invention is that the spacing of the sulfur ground state to the excited Sigma g states at about 2 eV, and the excited Sigma g states to the Sigma u states, have similar energy values, fortuitously all in the visible spectrum. By producing excited electrons with a peaked energy distribution at about 2 eV, the above desired transitions can be pumped very efficiently.

Operating Characteristics— Bulb 10 consists of an evacuated quartz envelope with a charge of elemental sulfur and backfill of a starting gas which is typically a noble gas. Thus, when RF energy is applied via electrodes 14 and 14' the noble gas is ionized into an electron plasma that heats and excites the sulfur. The noble gas is ionized near the inside surface of the bulb next to the exciting electrodes 14 and 14' with the electrons from the excited noble gas diffusing toward the center of bulb 10 with a velocity that is determined by the instantaneous electric field and the collision frequency of those electrons with the collision frequency being determined by the molecular density and the scattering cross sections of the electrons. Further, the sulfur is not ionized under operating conditions, it is a true molecular emitter with the visible emissions coming from the molecular vibrational state transitions. The molecular rotational states of the sulfur further smear the emission spectrum with the resulting spectrum forming a continuum.

Figure 6:
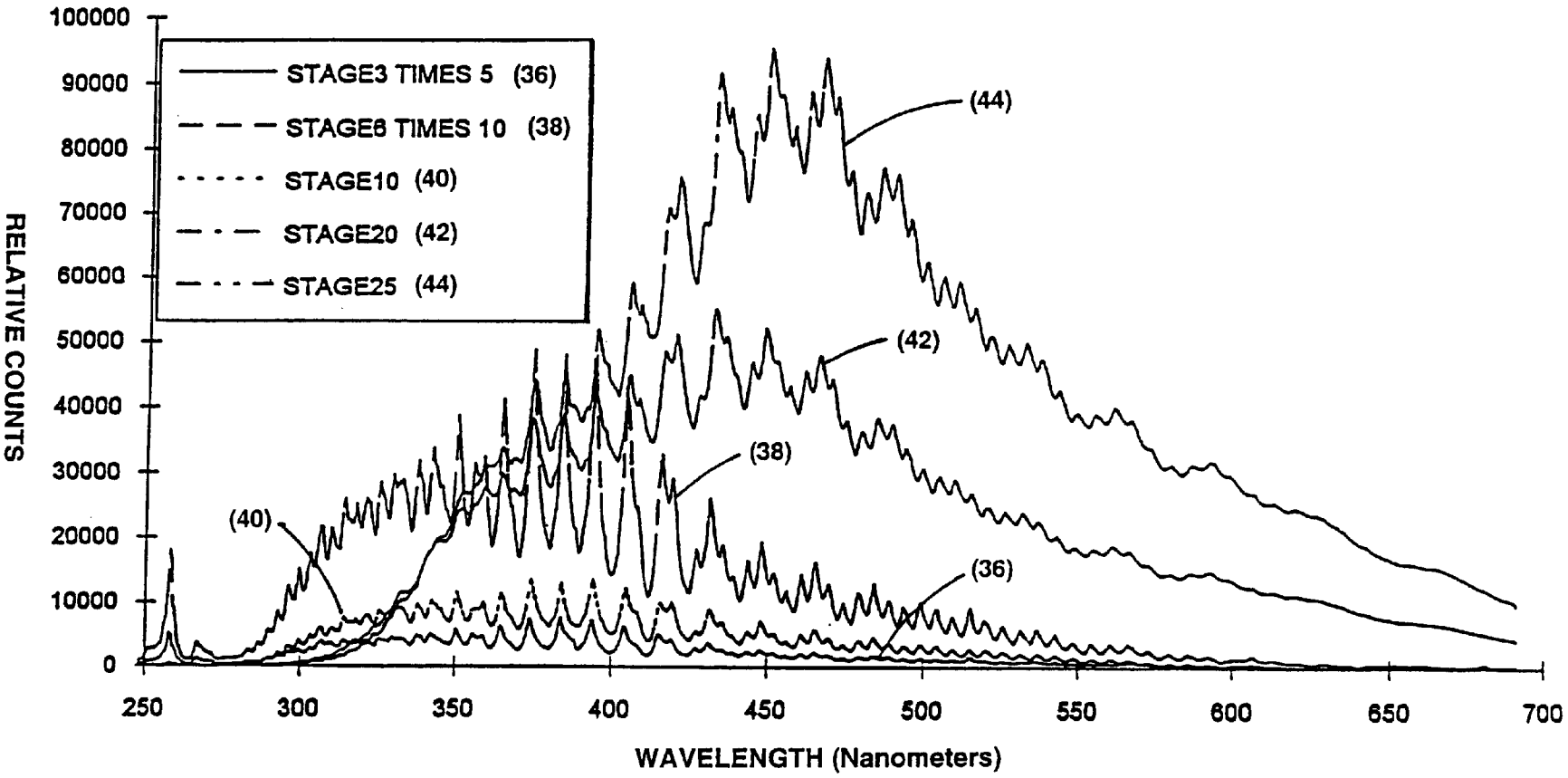
FIG. 6 is a plot of the emitted light spectra of sulfur in a sub-atmospheric environment from the beginning stages of excitation to the fully excited stage.

Striking and Heating— FIG. 6 illustrates the spectra of the sulfur emissions taken at different times during the turn-on cycle of bulb 10 when exposed to RF excitation. These time slices are characteristic of lamp turn-on cycles, but the rate is determined by how the RF power is applied. The initial two spectra (36 and 38) are of the early low pressure phase of the turn-on cycle and warm-up, and are of low amplitude. The lowest curve (36) has the character of a recombination peak at 260 nanometers (nm), with a band emission from 300 to 480 nm. As hot electrons are produced by the high E-field gradient in conditions of low sulfur pressure, some of the hot electrons have enough energy to dissociate the sulfur vapor to atomic sulfur. The recombination of the atomic sulfur to diatomic molecules emits that frequency characteristic of the dissociation energy (4.4 eV). The band emissions here are the electron excitation of sulfur to its Sigma u state and that state's decay to the ground state and low Sigma g states. The sulfur vapor is still cold and is mainly in the ground state.

The second spectrum (38) shows a continuation of the heating process showing the transition phase to the operational state. As the temperature increases, due to electron collisions with the sulfur, more sulfur is vaporized, the higher sulfur pressure cools the electron energy distribution such that the Sigma u states cannot be reached directly from the ground state with the Sigma g state having to be excited first, then re-excited to a Sigma u state. The transition of Sigma u to Sigma g excited state is favored over a direct ground state transition from a Sigma u state by Franck-Condon exclusion for the same reason the excited Sigma g states have long life times (100s of milliseconds). Conversely, the Sigma u states have life times in the nanosecond range.

The later spectra 40, 42, and 44 show the progression of the excited sulfur vapor to exclusively Sigma u and to the excited Sigma g states with the allowed transition producing each broad peaked spectra.

Figure 7:
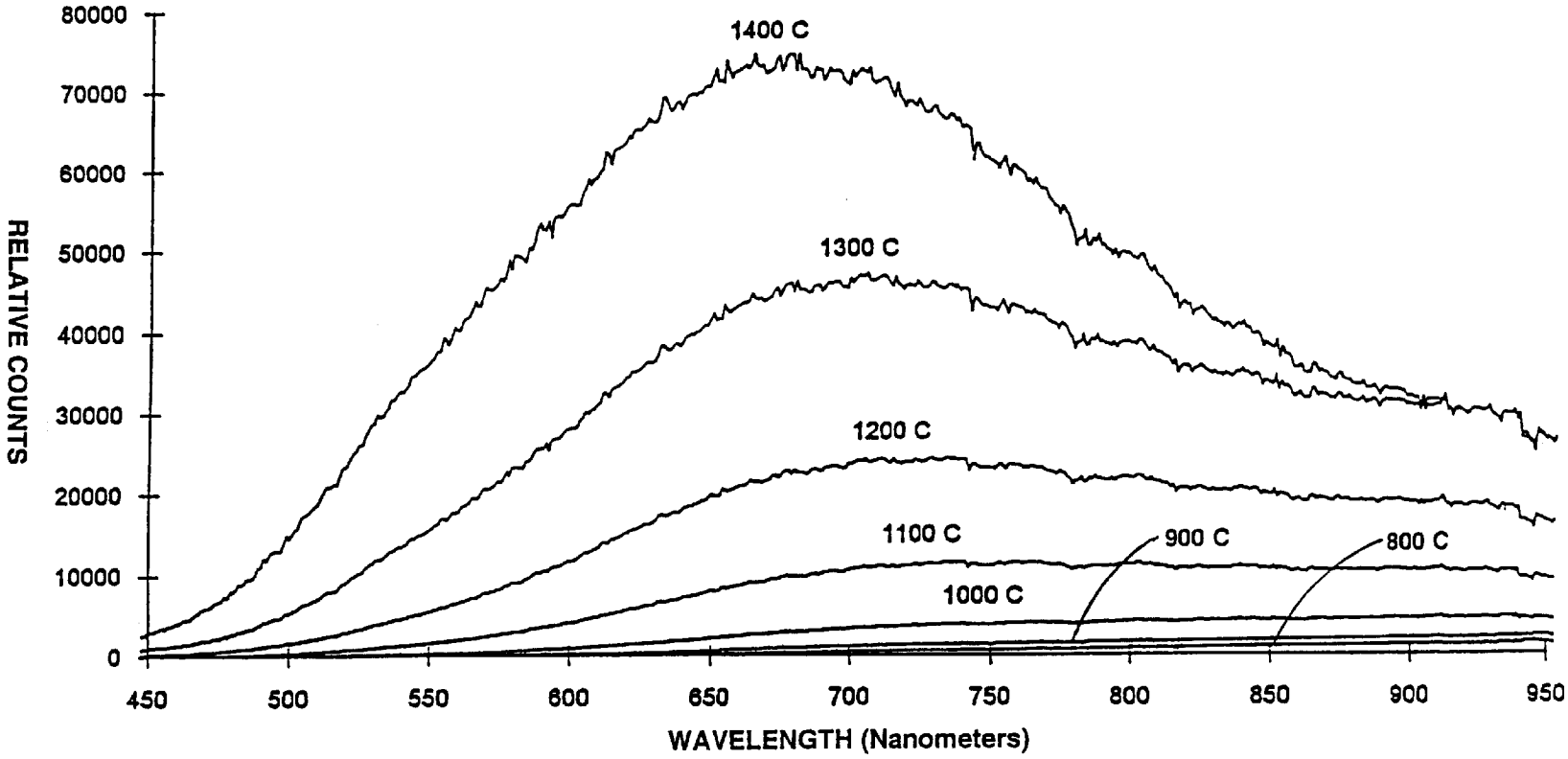
FIG. 7 is graph of the sulfur emission spectrum versus temperature with the emissions of the sulfur resulting from the temperature alone.

FIG. 7 has been included for purposes of comparison. Here the spectral emissions of sulfur in a bulb 10 subjected only to a range of stabilized, static temperatures (without any RF excitation) shown at 800° C., 900° C., 1000° C., 1100° C., 1200° C., 1300° C. and 1400° C. Note that at 1100° C. the spectrum begins to develop a peak at about 725 nm and as the temperature is increase to 1400° C. that peak migrates down to 675 nm with the shape of the overall spectral response becoming sharper.

Ionizing Gas—A noble gas must be used for the ionizing gas due to the reactivity of sulfur as noted above. The choice of the particular gas is dictated by several effects: ease of initiating a discharge requires a gas with a low ionization potential (i.e., a heavier one); the gas also serves as a thermal blanket and momentum transferring mechanism to cool the electron temperature of the discharge and equilibrate the sulfur molecules; and Xenon has the lowest ionization potential and thermal blanketing, however, Krypton may be more favorable for overall energy efficiency.

Thermal Management—Thermal management of bulb 10 is important to the overall efficiency of the lamp of the present invention. During the developmental phase it was believed that the minimum temperature for bulb 10 was about 350 to 375° C., with a low sulfur fill bulb. One of the requirements is to hold the blackbody and convective loss to a minimum. Three methods for doing that are possible. First, reduce the conduction loss of the gas to air interface by increasing the thermal impedance (i.e., thicken the lamp walls). Second, use selective coatings to inhibit radiation losses for wavelengths greater than visible and change the emissivity of the lamp surface for all long wavelengths. Third, use a secondary optical jacket outside of the electrode high field area with the proper coatings.

Wall Thickness—It was further determined that thickening of the lamp walls presents a trade-off problem. A key to maximizing bulb efficiency is to reduce thermal losses, because the bulb wall(s) must reach at least 450° C. to maintain the sulfur in a gaseous dimer state. A method of thermal management for the low powered bulb can be accomplished via thicker glass walls. A thicker lamp wall will produce a larger thermal gradient in the lamp wall, which in turn, gives a lower outer wall temperature. This aids in reducing convective thermal losses. However, the gas temperature is a function of the electron energy. Thus, if a high field gradient is present at the inner bulb wall, even though the gas pressure is high, hot electrons will be produced locally heating the gas, and produce plasma streamers—the result is loss of efficiency. Thicker walls, in addition to the thermal management effects, increases the effective spacing required of electrodes 14 and 14' from bulb 10, which requires higher RF field potentials. The result is the increase in the reactive impedance which is counter to efficient RF coupling, thus there is a balance between the wall thickness and the electrode impedance, that is dependent on the plasma conductance requiring an optimal thickness to be determined which balances lamp efficiency and plasma stability.

Gas Mechanics—At the inner surface of bulb 10 the field strength is increased to the conductive plasma sheath which is the ionization region. The noble gas is ionized and the electrons start to diffuse because of their high mobility, however, the high frequency electric field alternates sufficiently fast so that during a single period of the RF waveform the electrons do not move a significant distance, however, the electrons are able to gain enough energy from the electric field to collide with and excite the sulfur molecules. The enhanced electron density in the sheath region and the spinning bulb 10 provides the diffusion potential. Since the noble gas in the body of the plasma is not subjected to a high enough field gradient to allow ionization, thus recombination of the noble gas occurs mainly in the sheath area and by scanning that area with a telescopic spectrometer yields a weak noble gas spectrum.

Gas Circulation—Bombardment of the sulfur vapor by electrons heats the gas and the spinning of bulb 10 causes a centripetal force toward the inner surface of the wall of bulb 10 perpendicular to the spin axis. Because of the density gradient, hot gas responds by "floating" toward the spin axis and as the gas cools by radiation it is squirted out of the spin axis to the polar regions. From there the gas returns down the inner bulb wall, back to the ionization region, repeating the cycle. The Coriolis forces mix the gas into the plasma making it appear relativity uniform in intensity. Measurement of the radial light distribution gives slightly brighter down pole in relation to up pole relative to gravity since the heavier components sink to the "bottom" of the interior of bulb 10 providing a denser dimer production area.

$CO_2$ Scavenging—As a part of the present invention, it was determined that a supplemental $CO_2$ fill within bulb 10 reduced the processing sanitation requirements. The addition of $CO_2$ to the inert gas fill permits, under operating conditions, the oxidation of any organic compounds within bulb 10 with the $CO_2$ scavenging reducing the elemental carbon that might exist within bulb 10. By reducing the elemental carbon the plating-out of elemental carbon on the interior lamp surface is reduced, thereby effectively eliminating a potential shunting resistive component to the lamp's discharge path.

Figure 8:
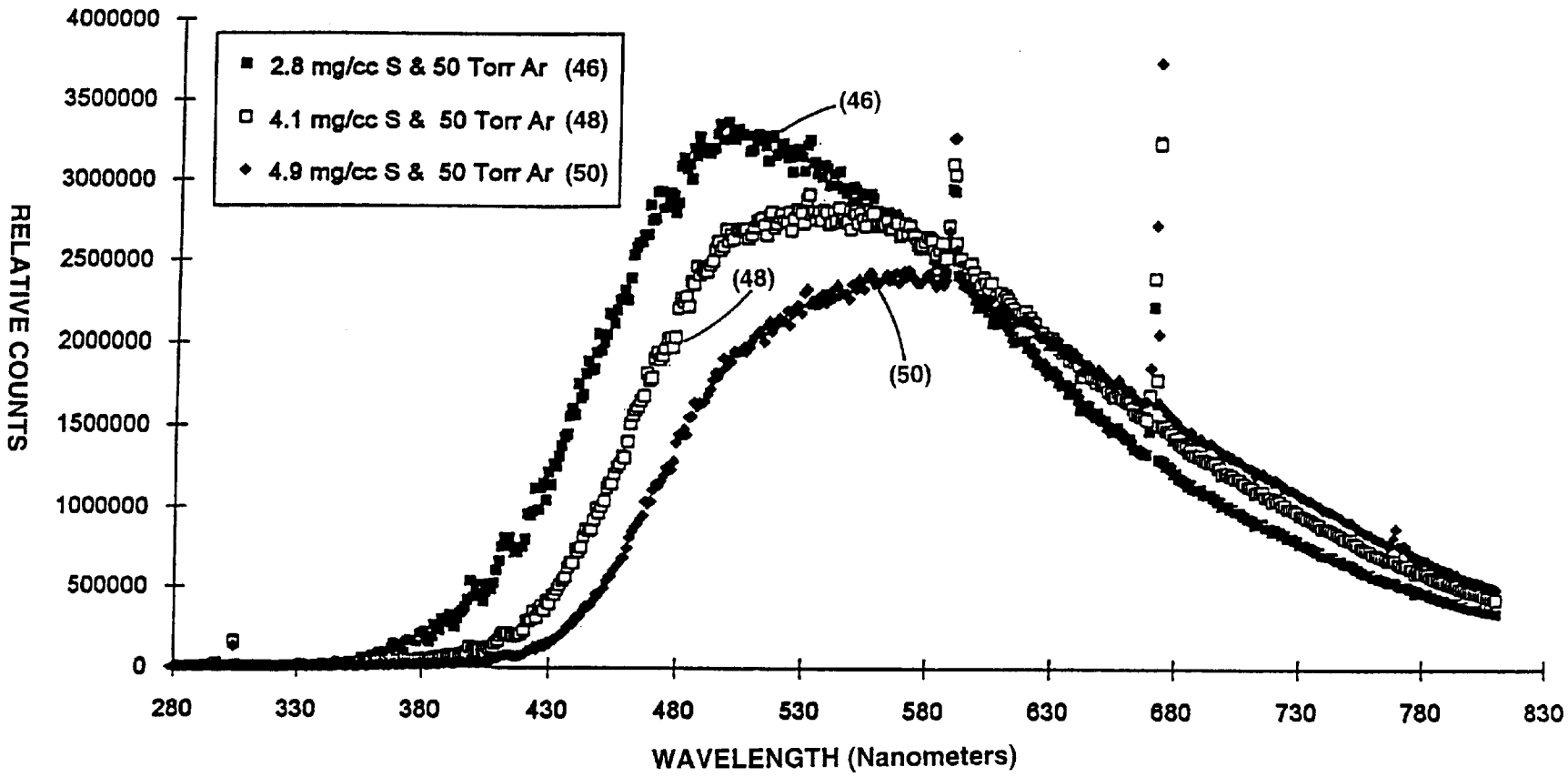
FIG. 8 is a graph of the spectral shift of the sulfur emission spectrum versus the sulfur fill.

Peak Spectral Wavelength Versus Sulfur Fill—As shown in FIG. 8, as the sulfur fill is increased (2.8 mg/cc to 4.9 mg/cc), while otherwise maintaining the same conditions within bulb 10' (50 Torr Argon), the spectral peak frequency (inverse of emission wavelength) and the intensity of the peak emission both decrease. Thus, the amount of the sulfur fill can be used to shift the spectral maximum in the radiated (visible) spectrum from the near-ultraviolet (46) through an intermediate setting (48) to the near-infrared (50) (during experimentation it was noted that the spectral peak can be varied between approximately 400 nm to 700 nm). Additionally, it was observed that the width of the spectral peak spreads, or flattens out, (50) as the sulfur fill is increased and that the peak radiometric efficiency (maximum intensity of emission at spectral peak) the lamp charged as in FIG. 8 occurs when the broad spectral maximum is at approximately 480 nm with a sulfur charge of 2.8 mg/cc with 50 Torr of Argon in bulb 10' (46). Therefore, it can be seen that the variation of the sulfur fill allows a large range of whitish color in the light, as well as luminous efficacies, ascribed to the low power sulfur lamp of the present invention.

Lamp Characteristics—From the above discussion it can be seen that the sulfur lamp of the present invention presents a very efficient, long life, lighting source. Based on the various tests conducted during the developmental phase it was determined that by properly accounting for all of the factors that influence efficiency, lamps of the present invention convert the input energy to whitish light with efficiencies that are greater than 60%—the highest of any lamp currently available (other than the low pressure sodium lamp, which emits a monochromatic yellow light that is generally unsuited to most lighting applications because of its low color rendition) with—input power in the range of 20 to 100 watts/cc of bulb 10.

One of the contributing factors to the efficiency of the lamp of the present invention is the quality of the RF coupling for transferring energy from the electrodes to the bulb. The smaller the air gap, as discussed above, greatly aids in the impedance matching within the lamp system—the better the impedance matching.

Additionally, the spherical lamp shape produces a very intense point source of light that can be manipulated with simple optics. That together with the spectral flexibility of the sulfur lamp, makes it possible to produce photosynthesis and high output daylight lamps.

Spectral Character—In similar tests, it was observed that the general shape of the spectral output curves shift from blue (lower wavelengths) to red (higher wavelengths) as the sulfur fill is increased from 2 mg/cc to 5 mg/cc with a low inert gas backfill of 10 Torr. That same shift was demonstrated with a flattening of the spectral peak by backfilling with 200 to 500 Torr of Krypton or Xenon and reducing the sulfur fill to 2 to 4 mg/cc, and white light was produced with a 3.2 mg/cc sulfur and 500 Torr Kr fill. It appears that the optimal behavior of the sulfur lamp of the present invention is inversely proportional to the concentration of the sulfur fill and directly proportional to the pressure of the inert gas fill with the commercial range of sulfur fill being approximately 2–6 mg/cc.

Figure 10:
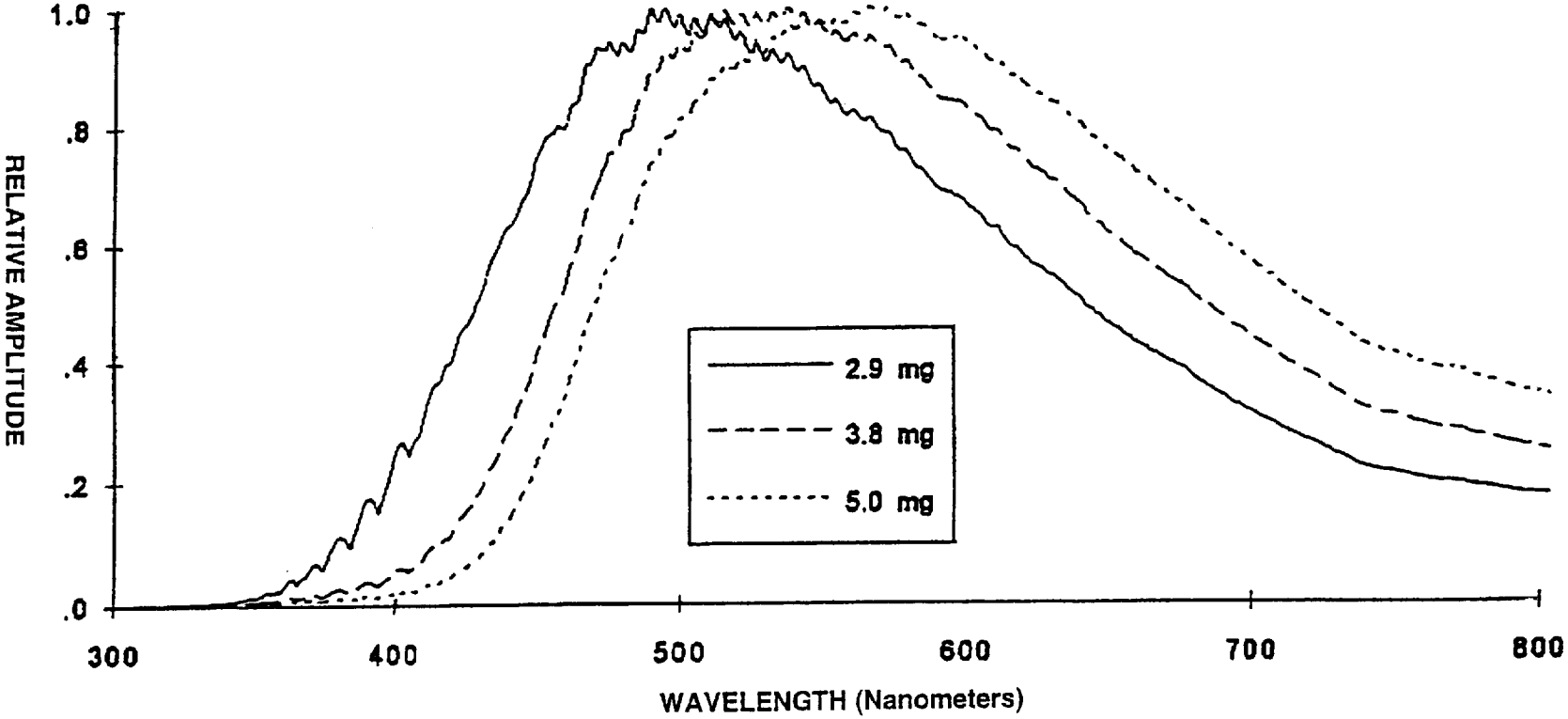
FIG. 10 is a graph of the spectral shift of the sulfur emission spectrum with a constant pressure of inert gas fill for different sulfur fills.

FIG. 10 has been included to illustrate the effect on the spectral response with various sulfur fills while holding the inert gas backfill pressure at 200 Torr of Krypton. The sulfur fills used here are 2.9 mg/cc, 3.8 mg/cc and 5.0 mg/cc as depicted by the respective curves. As shown in FIG. 10 the peak spectral responses are 480 nm, 510 nm and 560 nm, respectively.

Figure 9:
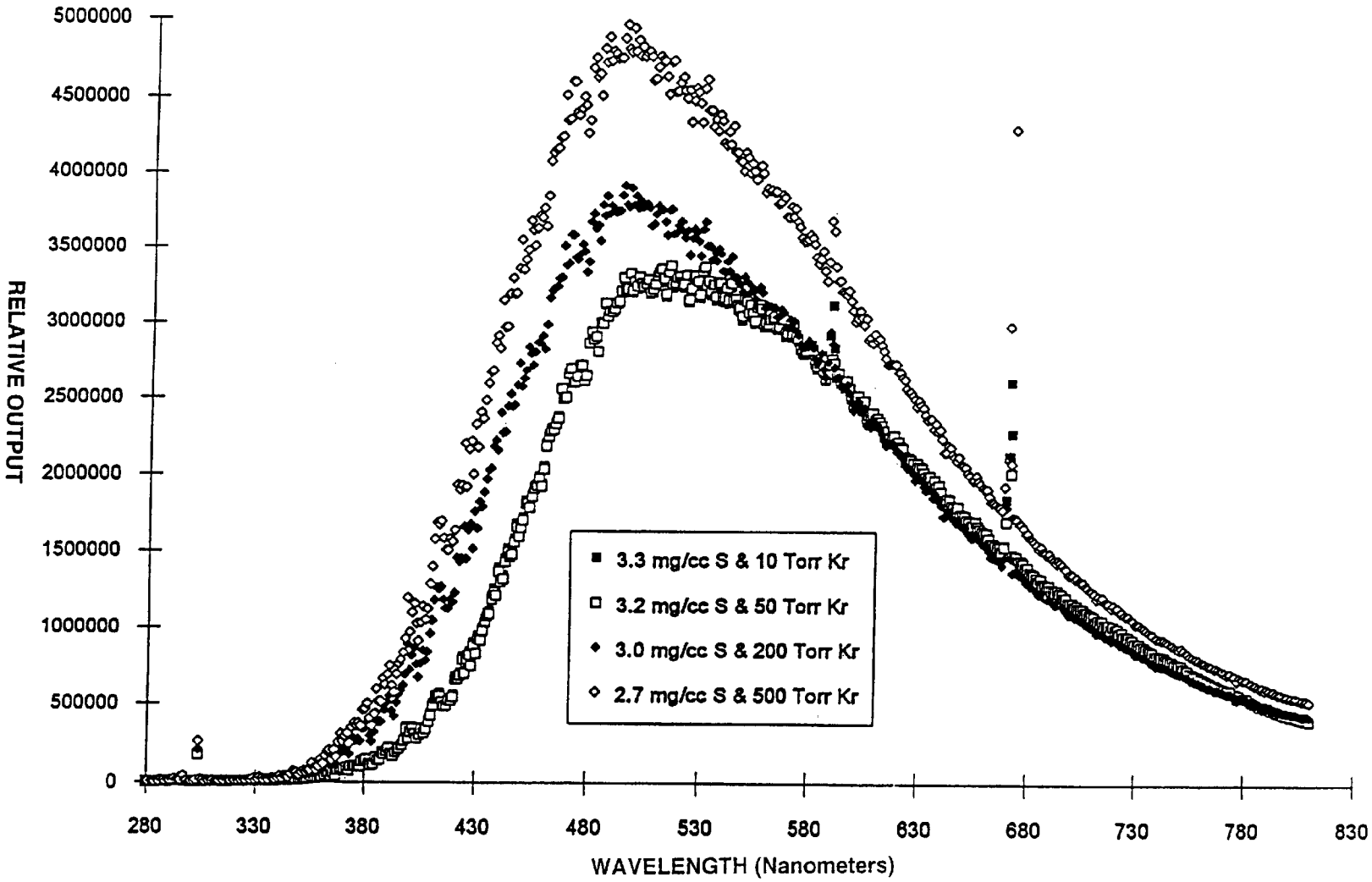
FIG. 9 is a graph of the spectral shift of the sulfur emission spectrum substantially versus the pressure of the inert fill gas.

FIG. 9 illustrates the effect of the increasing of the inert gas backfill pressure from 10 Torr to 500 Torr of Krypton while decreasing the sulfur fill from 3.3 mg/cc for the lower inert gas backfill pressure to 2.7 mg/cc for the higher inert gas backfill pressure. In FIG. 9 it appears that the peak performance occurs with the lowest sulfur fill and the highest inert gas fill, i.e. 2.7 mg/cc of sulfur and Krypton at 500 Torr. Also shown are a curve for a 3.2 mg/cc sulfur fill with a backpressure of 50 Torr Kr which is almost indistinguishable from the for 3.3 mg/cc of sulfur with a backpressure of 10 Torr Kr. Additionally there is a curve for 3.0 mg/cc of sulfur fill with a backpressure of 200 Torr of Kr, that is intermediate the 2.7 mg/cc and the 3.2/3.3 mg/cc curves and closer to the 3.2/3.3 mg/cc curves.

Thus, various sulfur fill concentrations, including those between 2 mg/cc and 5 mg/cc, may be used in lamps of the present invention. Further, the particular concentration level may be optimized for the particular lamp, application, or desired spectral output of the lamp.

E. Applications

General Lighting—The rotation requirements of some of the embodiments of the sulfur lamp suggests that these lamps may be used in a different way than other lamps currently in-use for general lighting purposes. Thus, these lamps would lend themselves, interalia, to single source area lighting which can be utilized, for example, by placing a mirror type defocused beam expander so that its focal point is at the near point source emission surface of the sulfur lamp. This combination will produce very uniform lighting over a large surface area for moderate ceiling heights.

Projection Light Source—In regard to a further application, the combination of a point source of high luminosity and flat spectrum which can be tilted toward the blue, such as the sulfur lamp of the present invention, is an ideal lamp for a projection source. Being a single source which contains the complete visible spectrum, dichroic splitting of the beam into three color channels, modulating them, then recombining into a single sweepable beam with static color balance is a good way to make an inexpensive projection television.

Display Lighting—A further specialized application would be to use the flat spectral characteristic of the sulfur lamp to enhance the visibility characteristics of store windows and floor displays.

It is to be understood that the above discussions with respect to the experimental operation of the present invention with a bulb 10' as shown in FIGS. 1 and 2, also extend to the two other bulb configurations of FIGS. 3*b*–3*c*, as well as other configurations that may be devised, whether rotated or not. Additionally, the discussions with respect to the bulb fill material of the present invention apply, not only to elemental sulfur, but also to sulfur compounds and other elements and compounds with characteristics that are similar to those of sulfur, such as selenium and compounds of selenium.

While the above discussion has attempted to describe and illustrate several alternative embodiments and implementations of the present invention, it is not possible to illustrate or to anticipate all embodiments and applications of the present invention. However, with the disclosure-provided the necessary changes that would be needed to various other embodiments and applications would be obvious to one skilled in the art. Therefore, the scope of protection for the present invention is not to be limited by the scope of the above discussion, but rather by the scope of the appended claims.

What is claimed is:

1. A confined gaseous discharge device which radiates a spectral energy distribution when excited by RF energy, said discharge device comprising:

a cylindrical envelope that defines an interior space of a selected volume and a exterior surface, said interior space contains a fill material of a spectral energy emitting component of a sulfur containing substance and a noble gas, said envelope being transparent to at least a portion of the spectral energy emitted by said sulfur containing substance, wherein said envelope includes an elongated stem having an elongated axis with said stem affixed to the exterior of said envelope with said elongated axis aligned with a central cylindrical axis of said envelope;

a pair of electrodes facing each other through said envelope and closely spaced apart from said exterior of said envelope to create an unobstructed air-gap between each of said electrodes and said exterior surface of said envelope with each of said electrodes having a respective face of a convex partial cylindrical shape to complement said exterior shape of said envelope, each of said electrodes disposed to receive said RF energy, and to direct said RF energy into said interior space of said envelope to energize said fill material and to excite said spectral energy emitting component; and a rotational subsystem coupled to said elongated stem of said envelope so as to rotate said envelope between said pair of electrodes.

2. A confined gaseous discharge device which radiates a spectral energy distribution when excited by excitation energy, said discharge device comprising:

a spherical envelope that defines an interior space of a selected volume and a exterior surface, said interior space contains a fill material of a spectral energy emitting component of less than 6 mg of a sulfur containing substance per cc of the volume of said interior space of said envelope and a noble gas, said envelope being transparent to at least a portion of the spectral energy emitted by said sulfur containing substance, wherein said envelope is spherical and includes an elongated stem having an elongated axis, said stem affixed to the exterior of said envelope with the elongated axis of said stem substantially in alignment with a major spherical axis of said envelope;

a pair of electrodes facing each other through said envelope and closely spaced apart from said exterior of said envelope to create an unobstructed air-gap between each of said electrodes and said exterior surface of said envelope with each of said electrodes having a respective face of a convex partial spherical shape to complement said exterior shape of said envelope, each of said electrodes disposed to receive said excitation energy, and disposed external and adjacent said exterior surface of said envelope, to direct said excitation energy into said interior space of said envelope to energize said fill material and to excite said spectral energy emitting component; and a rotational subsystem coupled to said elongated stem of said envelope so as to rotate said envelope between said pair of electrodes.

3. A confined gaseous discharge device which radiates a spectral energy distribution when excited by excitation energy, said discharge device comprising:

an envelope that defines an exterior surface and an interior space of a selected volume, said interior space containing a fill material of a spectral energy emitting component of a sulfur containing substance and a noble gas, said envelope being transparent to at least a portion of the spectral energy emitted by said sulfur containing substance;

a pair of electrodes facing each other through said envelope and closely spaced apart from said exterior of said envelope to create an unobstructed air-gap between each of said electrodes and said exterior surface of said envelope, each of said electrodes disposed to receive said excitation energy, and to direct said excitation energy into said interior space of said envelope to energize said fill material and to excite said spectral energy emitting component; and a rotational subsystem coupled to said envelope to rotate said envelope about a selected axis of said envelope between said pair of electrodes;

wherein said spectral energy emitting component produces an output spectral energy distribution having a peak at a preselected wavelength thereof that corresponds to a particular fill density of said fill material wherein at least a portion of the output spectral energy distribution is in the a light spectrum which is visible to humans.

4. A discharge device as in claim 3 wherein:

said envelope exterior surface has a preselected shape; and each of said pair of electrodes includes a respective face of a preselected shape so as to complement said preselected shape of said envelope exterior surface with said respective face positioned a preselected distance from the exterior surface of said envelope so as to maximize the coupling of said excitation energy to said interior space of said envelope.

5. A discharge device as in claim 4 wherein said preselected shape of the respective face of said pair of electrodes minimizes the respective coupling distance between the corresponding faces of said electrodes and said exterior surface of said envelope thereby resulting in the minimization of a reactive coupling component of said RF energy due to a respective air gap between the exterior surface of said envelope and the face of said corresponding electrodes thus defining an RF operational frequency for said discharge device with the preselected shape of said envelope and said electrodes.

6. A discharge device as in claim 4 wherein said exterior shape of said envelope is spherical and said respective face of each of said pair of electrodes is a convex partial sphere so as to complement the spherical shape of said exterior surface of said envelope.

7. A discharge device as in claim 4 wherein said exterior shape of said envelope is cylindrical and said respective face of each of said pair of electrodes is a convex partial cylinder so as to complement the cylindrical shape of said exterior shape of said envelope.

8. A discharge device as in claim 3 wherein said sulfur containing substance is elemental sulfur.

9. A confined gaseous discharge device as in claim 3 wherein:

said spectral energy emitting component includes less than 6 mg of a sulfur containing substance per cc of the volume of said interior space of said envelope.

10. A discharge device as in claim 3 wherein said excitation energy is RF energy.

11. A confined gaseous discharge device as in claim 3 wherein:

said spectral energy emitting component includes less than 6 mg of a sulfur containing substance per cc of the volume of said interior space of said envelope; and said spectral energy emitting component is energized by excitation energy having a frequency of less than 1 GHz and at least 10 MHz.

12. A confined gaseous discharge device as in claim 3 wherein:

said excitation energy is RF energy;

each of said electrodes is disposed to receive RF energy, and to direct said RF energy into said interior space of said envelope to energize said fill material and to excite said spectral energy emitting component; and said RF energy has a frequency of less than 1 GHz and at least 10 MHz.

13. A confined gaseous discharge device which radiates a spectral energy distribution when excited by excitation energy, said discharge device comprising:

an envelope that defines an exterior surface and an interior space of a selected volume, said interior space containing a fill material of a spectral energy emitting component of a sulfur containing substance and a noble gas, said envelope being transparent to at least a portion of the spectral energy emitted by said sulfur containing substance;

a pair of electrodes facing each other through said envelope and closely spaced apart from said exterior of said envelope to create an unobstructed air-gap between each of said electrodes and said exterior surface of said envelope, each of said electrodes disposed to receive said excitation energy, and to direct said excitation energy into said interior space of said envelope to energize said fill material and to excite said spectral energy emitting component; and a rotational subsystem coupled to said envelope to rotate said envelope about a selected axis of said envelope between said pair of electrodes;

wherein said spectral energy emitting component is energized by excitation energy having a frequency of less than 1 GHz and at least 10 MHz.

14. A confined gaseous discharge device as in claim 13 wherein:

said excitation energy is RF energy; and each of said electrodes is disposed to receive said RF energy, and to direct said RF energy into said interior space of said envelope to energize said fill material and to excite said spectral energy emitting component, wherein said RF coupling device couples less than 100 watts of RF power to the interior space of said envelope per cc of the volume of said interior space.

15. A discharge device as in claim 13 wherein:

said envelope exterior surface has a preselected shape; and each of said pair of electrodes includes a respective face of a preselected shape so as to complement said preselected shape of said envelope exterior surface with said respective face positioned a preselected distance from the exterior surface of said envelope so as to maximize the coupling of excitation energy to said interior space of said envelope.

16. A discharge device as in claim 15 wherein said preselected shape of the respective face of said pair of electrodes minimizes the respective coupling distance between the corresponding faces of said electrodes and said exterior surface of said envelope thereby resulting in the minimization of a reactive coupling component of said excitation energy due to a respective air gap between the exterior surface of said envelope and the face of said corresponding electrodes thus defining an excitation operational frequency for said discharge device with the preselected shape of said envelope and said electrodes.

17. A discharge device as in claim 15 wherein said exterior shape of said envelope is spherical and said respective face of each of said pair of electrodes is a convex partial sphere so as to complement the spherical shape of said exterior surface of said envelope.

18. A discharge device as in claim 15 wherein said exterior shape of said envelope is cylindrical and said respective face of each of said pair of electrodes is a convex partial cylinder so as to complement the cylindrical shape of said exterior shape of said envelope.

19. A confined gaseous discharge device as in claim 13 wherein:

said spectral energy emitting component includes less than 6 mg of a sulfur containing substance per cc of the volume of said interior space of said envelope and said excitation coupling device couples less than 100 watts of excitation power to the interior space of said envelope per cc of the volume of said interior space.

20. A confined gaseous discharge device which radiates a spectral energy distribution when excited by excitation energy, said discharge device comprising:

an envelope that defines an exterior surface and an interior space of a selected volume, said interior space containing a fill material of a spectral energy emitting component of a sulfur containing substance and a noble gas, said envelope being transparent to at least a portion of the spectral energy emitted by said sulfur containing substance;

a pair of electrodes facing each other through said envelope and closely spaced apart from said exterior of said envelope to create an unobstructed air-gap between each of said electrodes and said exterior surface of said envelope, each of said electrodes disposed to receive said excitation energy, and to direct said excitation energy into said interior space of said envelope to energize said fill material and to excite said spectral energy emitting component; and a rotational subsystem coupled to said envelope to rotate said envelope about a selected axis of said envelope between said pair of electrodes;

wherein said noble gas and a backfill pressure of said noble gas varies the peak intensity and wavelength thereof of said spectral energy distribution emitted from said envelope.

21. A discharge device as in claim 20 wherein said backfill pressure of said noble gas is less than 1 atmosphere.

22. A discharge device as in claim 20 wherein as the backfill pressure of said noble gas is increased a corresponding spectral wavelength of an output peak of the spectral energy distribution of said discharge device decreases.

23. A confined gaseous discharge device which radiates a spectral energy distribution when excited by excitation energy, said discharge device comprising:

an envelope that defines an exterior surface and an interior space of a selected volume, said interior space containing a fill material of a spectral energy emitting component of a sulfur containing substance and a noble gas, said envelope being transparent to at least a portion of the spectral energy emitted by said sulfur containing substance;

a pair of electrodes facing each other through said envelope and closely spaced apart from said exterior of said envelope to create an unobstructed air-gap between each of said electrodes and said exterior surface of said envelope, each of said electrodes disposed to receive said excitation energy, and to direct said excitation energy into said interior space of said envelope to energize said fill material and to excite said spectral energy emitting component, wherein said excitation coupling device couples less than 100 watts of excitation power to the interior space of said envelope per cc of the volume of said interior space; and a rotational subsystem coupled to said envelope to rotate said envelope about a selected axis of said envelope between said pair of electrodes.

24. A confined gaseous discharge device as in claim 23 wherein:

said excitation energy is RF energy;

each of said electrodes is disposed to receive said RF energy, and to direct said RF energy into said interior space of said envelope to energize said fill material and to excite said spectral energy emitting component; and said noble gas and a backfill pressure of said noble gas varies the peak intensity and wavelength thereof of said spectral energy distribution emitted from said envelope.

25. A confined gaseous discharge device as in claim 23 wherein:

said spectral energy emitting component includes less than 6 mg of a sulfur containing substance per cc of the volume of said interior space of said envelope; and said noble gas and a backfill pressure of said noble gas varies the peak intensity and wavelength thereof of said spectral energy distribution emitted from said envelope.

26. A discharge device as in claims 12, 11 or 13 wherein said envelope is comprised of quartz.

27. A discharge device as in claims 3, 9, 12, 11, 13, 14, 19, 23, 24, 25, 20, 1, or 2 wherein said air-gap between each of said pair of electrodes and said envelope is in the range of 0.025 inches.

* * * * *